United States Patent [19]

Aujla et al.

[11] 4,435,034

[45] Mar. 6, 1984

[54] CONNECTORS WITH INSULATION-DISPLACING TERMINALS

[75] Inventors: Sharanjit S. Aujla, Kanata; John D. Lee, Manotick, both of Canada

[73] Assignee: Northern Telecom Limited, Montreal, Canada

[21] Appl. No.: 309,606

[22] Filed: Oct. 8, 1981

[51] Int. Cl.[3] ..... H01R 13/39

[52] U.S. Cl. ..... 339/98

[58] Field of Search ..... 339/17 CF, 36, 98, 97 R, 339/97 P, 99 R

[56] References Cited

U.S. PATENT DOCUMENTS

| | | | |
|---|---|---|---|
| 3,096,132 | 7/1963 | Hybbell | 339/36 |
| 3,162,501 | 12/1964 | Wahl | 339/98 |
| 3,573,713 | 4/1971 | Enright et al. | 339/98 |
| 3,718,888 | 2/1973 | Pasternak | 339/98 |
| 3,760,331 | 9/1973 | Turley | 339/36 |
| 3,812,449 | 5/1974 | Elm | 339/98 |
| 3,845,236 | 10/1974 | Anderson | 339/98 |
| 3,858,157 | 12/1974 | Bazille, Jr. | 339/98 |
| 3,971,615 | 7/1976 | Hashimoto | 339/98 |
| 4,017,140 | 4/1977 | Reavis, Jr. et al. | 339/98 |
| 4,033,661 | 7/1977 | Moody et al. | 339/98 |
| 4,176,895 | 12/1979 | Aldridge | 339/17 CF |
| 4,178,055 | 12/1979 | Fleischhacker et al. | 339/98 |
| 4,326,767 | 4/1982 | Lilbernagel et al. | 339/98 |

*Primary Examiner*—Joseph H. McGlynn

*Attorney, Agent, or Firm*—Sidney T. Jelly

[57] ABSTRACT

A connector for connecting at least two insulated conductors, for example telephone line conductors, comprises a hollow body and a hollow cap, the cap, in a typical example fitting into the body to form an enclosure. The front of the body has apertures and guides for admission and guidance of conductors thereinto and the cap has insulation displacing terminals set in a top web. When body and cap are pressed together the terminals make contact with the conductive cores of the conductors. Terminal arrangements permit of butt, bridge and tap connections. A modified form of body permits a tap to be made to a continuous conductor. The cap and body can be provided in a partially assembled or first stage assembly which permits insertion of conductors, the cap and body then being pressed to a fully assembled or second stage assembly for connection of the conductors.

17 Claims, 42 Drawing Figures

CONNECTORS WITH INSULATION-DISPLACING TERMINALS

This invention relates to connectors with insulation-displacing terminals, particularly, although not exclusively, for connecting wires of telecommunications systems. The connector of the invention is particularly suited to the connection of the Tip and Ring conductors of telephone systems.

There are many existing connectors, of varying forms, with various disadvantages, the disadvantages differing with the form of the connector. Typical disadvantages are lack of effective guidance of conductors into a connector; inability to test other than by piercing the insulation of conductors exterior to the connector, resulting in a perforated insulation; need to separately pair up Tip and Ring conductors for connection; use of two connectors for a butt connection; inability to interconnect three conductors; inadequate sealing against water ingress. The particular disadvantages pertaining to any particular connector vary, and other disadvantages can also be present.

Ideally a connector should make a variety of connections, e.g. butt, bridge and tap, with various types of plastic, paper and pulp insulation. Connectors should be reliable over a long period of time and also have a high level of environmental protection. As they are used in large numbers, they should be inexpensive and easy to install.

The present invention provides a connector with improved mechanical and electrical characteristics; is easily manufactured and inexpensive; is small in size; and can be provided with easy access which facilitates testing.

A connector, in accordance with the invention, comprises a body and a cap, the cap interrelating with the body and held together by interlocking formations. Insulation displacing terminals are retained in the cap, the insulated conductors being inserted laterally into the body. Final assembly of the connector forces the terminals into electrical contact with the conductors. The terminals may be in pairs, for certain forms of interconnections, for example a butt connection, and in a strip of four terminals, the strip bent into a U-shape for other forms of interconnections such as bridge and full tap. The body has two versions, each with four entry apertures, one version also having a side slot for a tap connection. A sealing compound is normally added before or after the connector parts are assembled.

Various features and details of the invention will be appreciated from the following description of certain embodiments, with respect to the accompanying drawings, in which:

FIG. 9 is a top plan view of the body of the connector of

Figure 36:
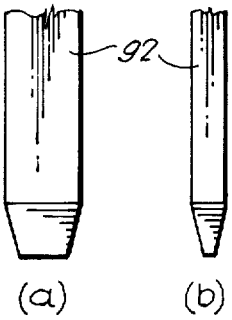
Figure 37:
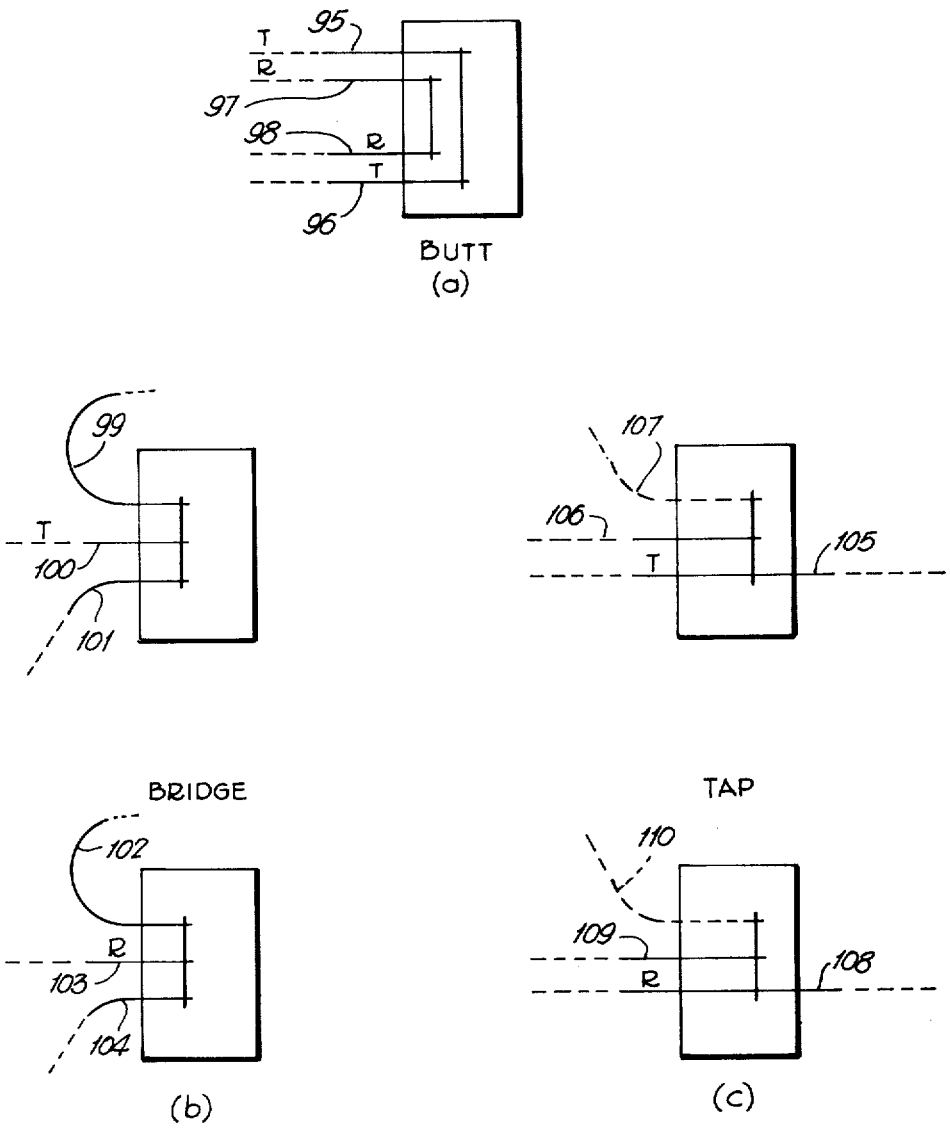

FIG. 36 (*a*) and (*b*) are face and side views respectively of the end of one form of electrical probe;

FIG. 37 (*a*), (*b*) and (*c*) are diagrammatic illustrations of various forms of connections to be made with connectors of the present invention.

Figure 15:
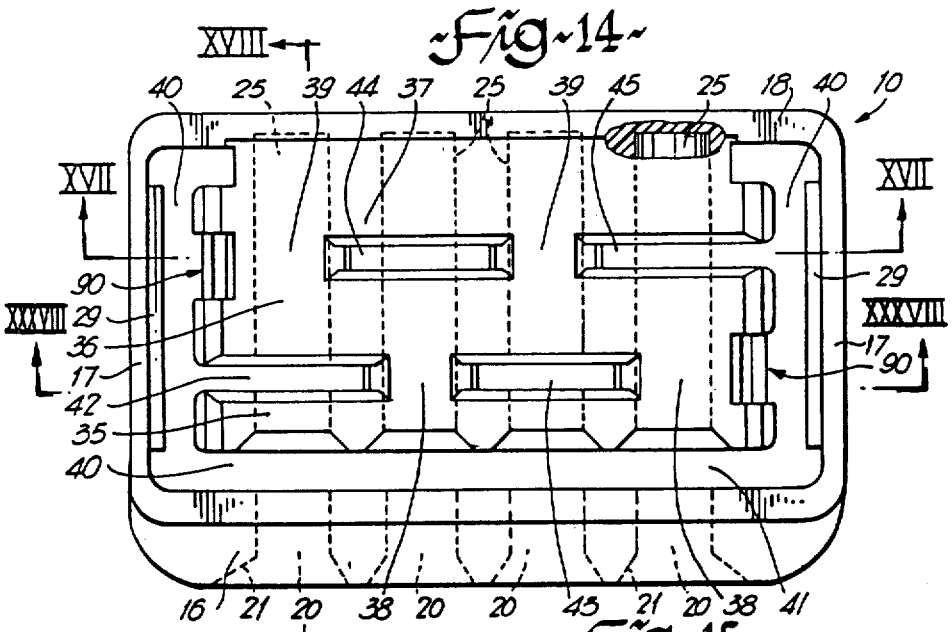
FIG. 15 is a top plan view of an alternative form of body, similar in many respects to that of the connector of FIG. 1.
Figure 38A:
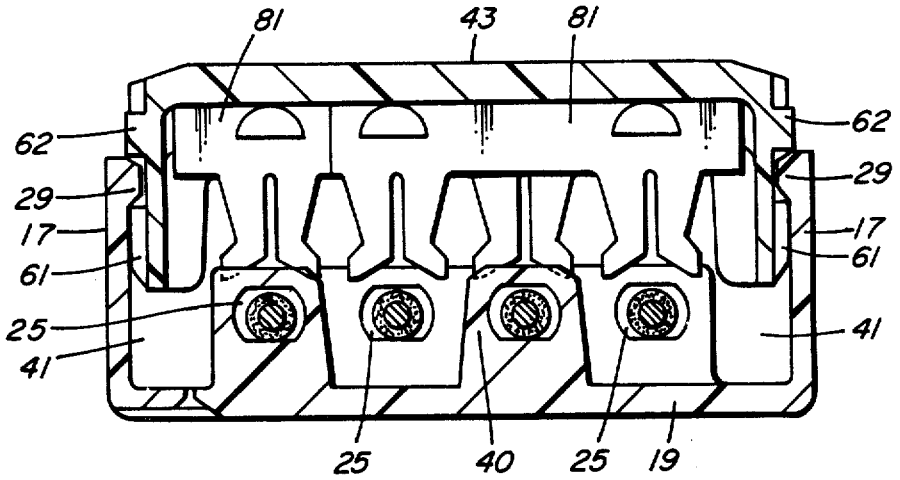
Figure 38B:
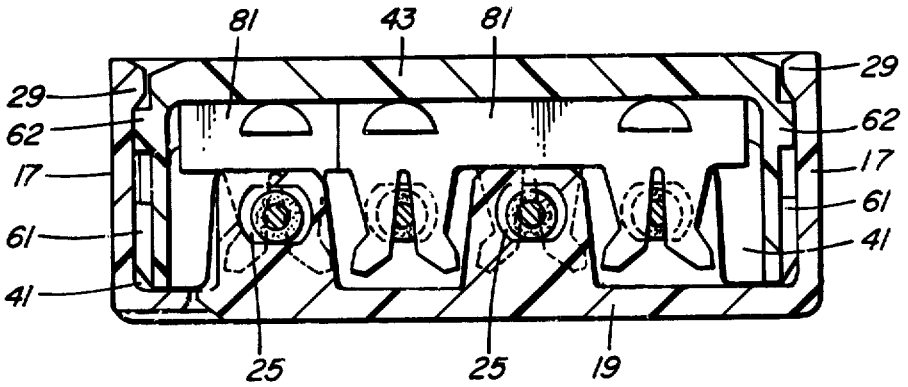

FIGS. 38(*a*) and 38(*b*) are cross-sections, as on the line XVIII—XVIII on FIG. 15, of a connector in an initial assembled condition and in a final assembled condition respectively.

Figure 2:
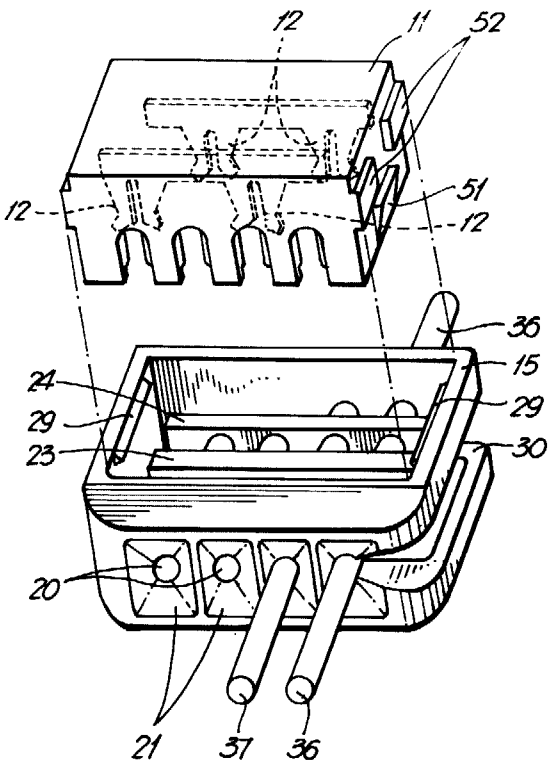
FIG. 2 is similar to FIG. 1 and illustrates the alternative form of body.
Figure 1:
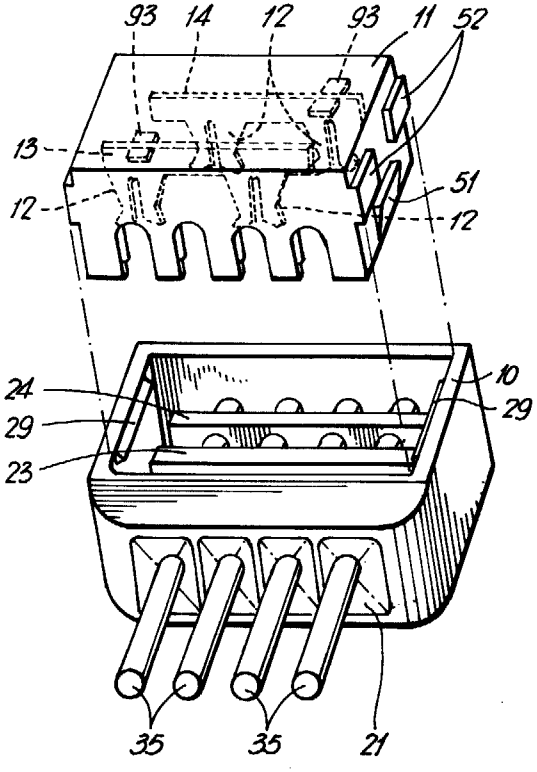
FIG. 1 is a perspective view of the two parts of a connector of one form.

As previously stated, a connector comprises a body and a cap, the body being capable of having forms depending, amongst other things, on the use. FIGS. 1 and 2 illustrate two alternate connectors. FIG. 1 illustrates a connector having a body 10 and cap 11 which interrelate to form the connector. The cap holds four terminals 12 in two pairs 13 and 14, the pairs being in parallel, spaced apart relationship and with the terminals of one pair offset laterally to the other. Four conductors 35 are shown inserted. In the connector illustrated in FIG. 2, an alternative form of body 15 is used, with the same cap 11 as in FIG. 1. Four terminals 12 are in the cap, the terminals in one strip which is bent in a U-shape with the two legs of the U in parallel spaced apart relationship, a pair of terminals 12 in each leg and the terminals in one leg offset laterally relative to the terminals in the other leg. In this arrangement one continuous conductor 36 and the end of a conductor 37 are shown inserted.

One form of the body 10 of the connector of FIG. 1 is illustrated in more detail in FIGS. 3 to 8. The body 10, as appreciated from FIG. 1, is of hollow box-like form having a relatively thick front wall 16, sides 17 and back 18, all extending up from a bottom surface or web 19. In the front wall are four apertures 20. The forward ends of the apertures 20 are chamfered at 21, to aid in inserting conductors into the apertures.

Figure 7:
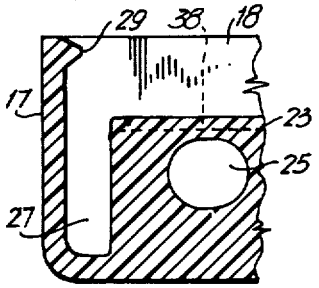
FIG. 7 is a cross-section on the line VII—VII of FIG. 3.
Figure 5:
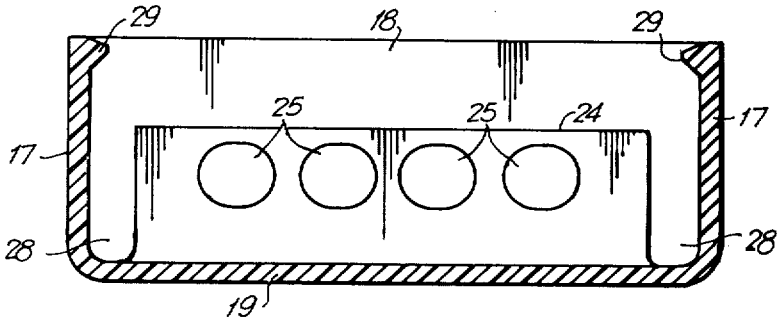
FIG. 5 is a cross-section on the line V—V of FIG. 3.

The bottom web 19 has three upstanding ribs 22, 23 and 24 extending laterally and apertures 25 extend through the ribs, aligned with apertures 20. The ribs define two lateral channels 26. A peripheral channel or space 27 extends all round inside the front wall and sides. Extending between the back 18 and the rib 24 are separators 28. Adjacent to the top edge of each side 17, on the inside thereof, is an inwardly projecting rib 29. These ribs 29 are of a truncated conical cross-section, as seen in FIGS. 5 and 7.

Figure 9:
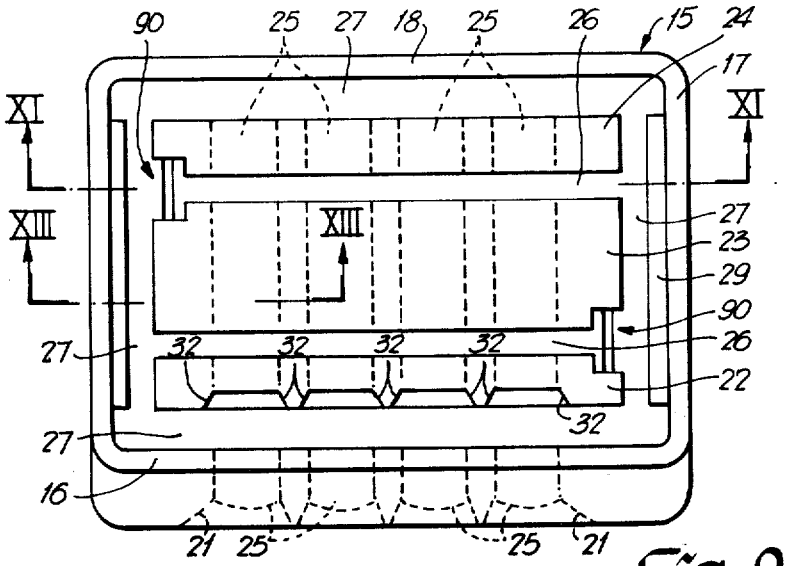
Figure 10:
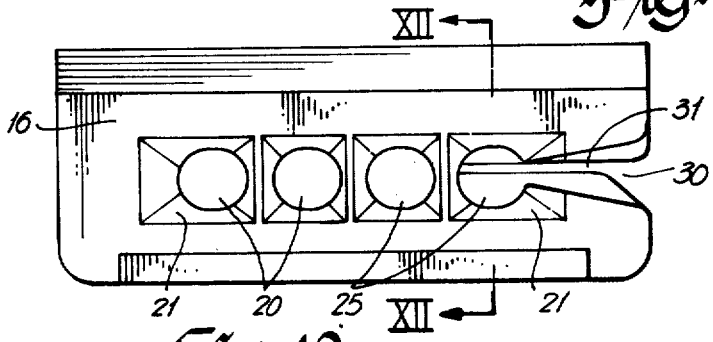
FIG. 10 is a front view of the body of FIG. 9.
Figure 11:
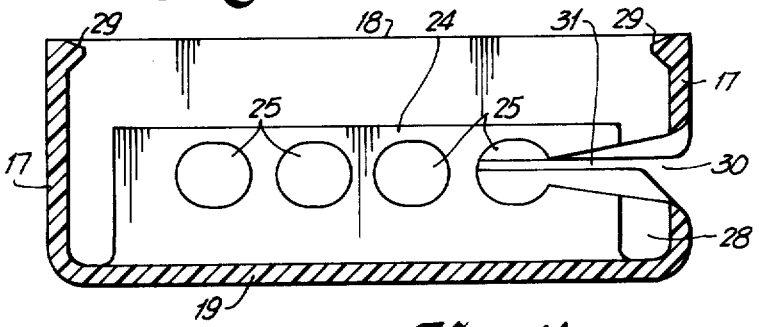
FIG. 11 is a cross-section on the line XI—XI of FIG. 9.
Figure 14:
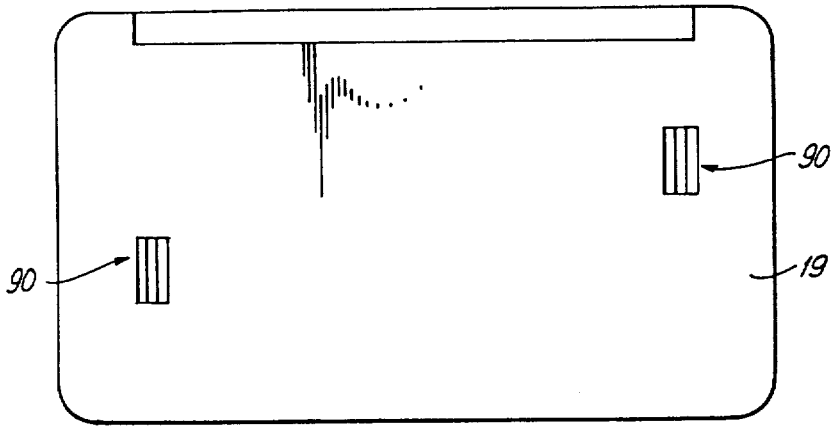
FIG. 14 is a bottom plan view of the body of FIG. 9.

The body 15 of the connector of FIG. 2 is illustrated in more detail in FIGS. 9 to 14. The body 15 is similar in most respects to that of body 10 and where applicable the same reference numerals have been applied to the same items. Thus there is the thick front wall 16, sides 17 and back 18, extending up from the bottom web 19. Apertures 20, chamfered at 21 are in the front wall 16 and the three upstanding ribs 22, 23 and 24 define channels 26 and have apertures 25 therein. Inwardly extending ribs 29 extend along the inside of each side 17, adjacent to the top edge. Thus far the bodies 10 and 15 are the same. A difference in body 15 is the slot or groove 30 in one of the sides 17, the right hand side in FIGS. 9 and 10 for the particular embodiment illustrated. The slot 30 extends laterally to break through into the apertures 20 and 25 closest to the related side having the slot 30. This is seen in FIGS. 10 and 11. In this particular example the separators 28 are not provided. The slot 30 extends through the front wall 16 and the side 17, being tapered inwardly, to form a converging slot. However, at the back, the slot is reduced in width, at 31. This reduces substantially the relative deflection of the body when the body and cap are fully assembled. Also, the escape of grease is reduced when the end aperture is not used to receive a continuous conductor.

Figure 3:
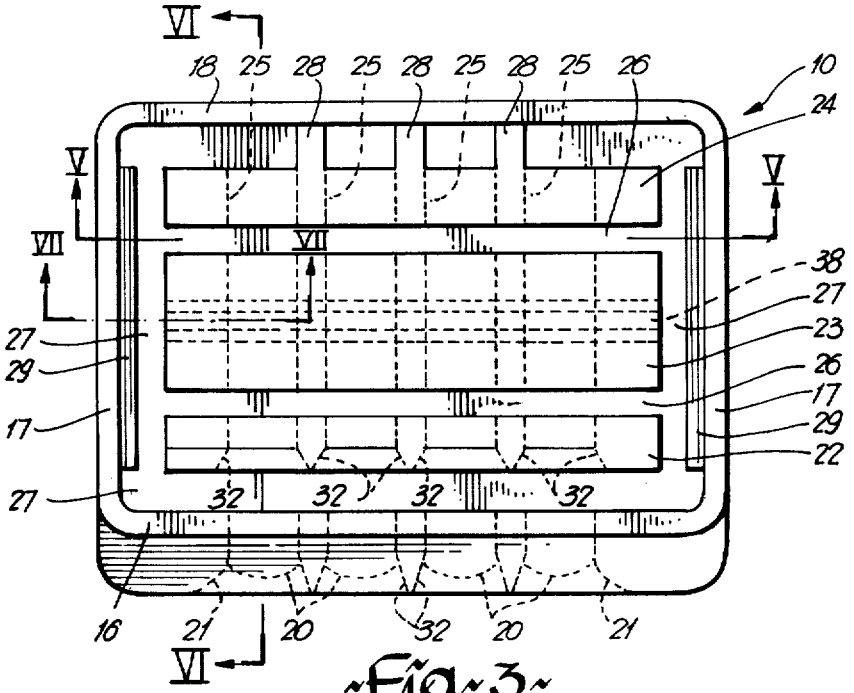
FIG. 3 is a top plan view of the body of the connector of FIG. 1.
Figure 4:
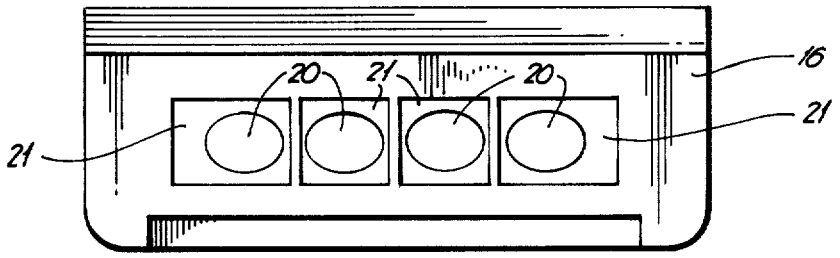
FIG. 4 is a front view of the body of FIG. 3.
Figure 8:
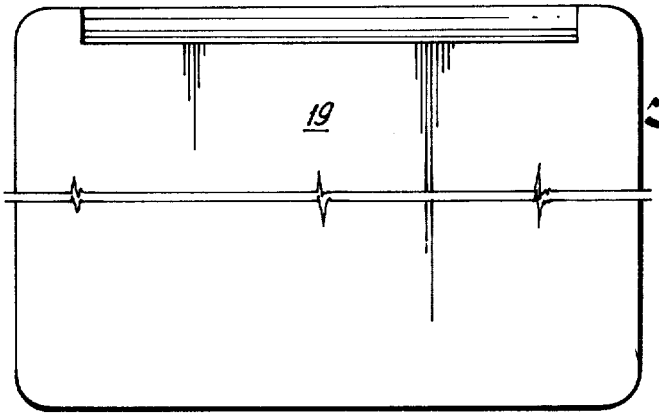
FIG. 8 is a bottom plan view of the body of FIG. 3.
Figure 6:
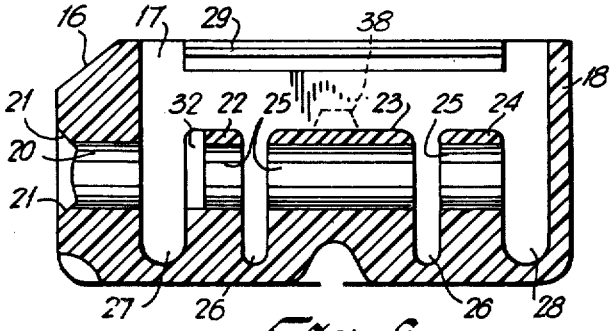
FIG. 6 is a cross-section on the line VI—VI of FIG. 4.
Figure 12:
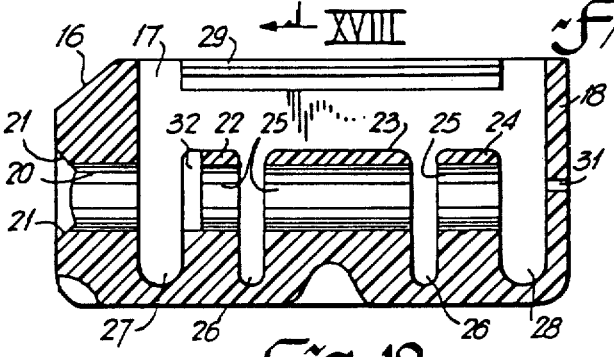
FIG. 12 is a cross-section on the line XII—XII of FIG. 10.
Figure 13:
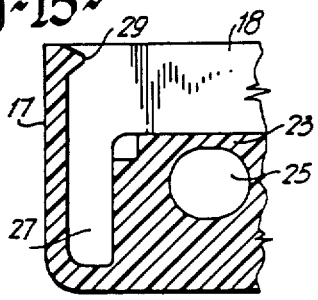
FIG. 13 is a cross-section on the line XIII—XIII of FIG. 9.
Figure 16:
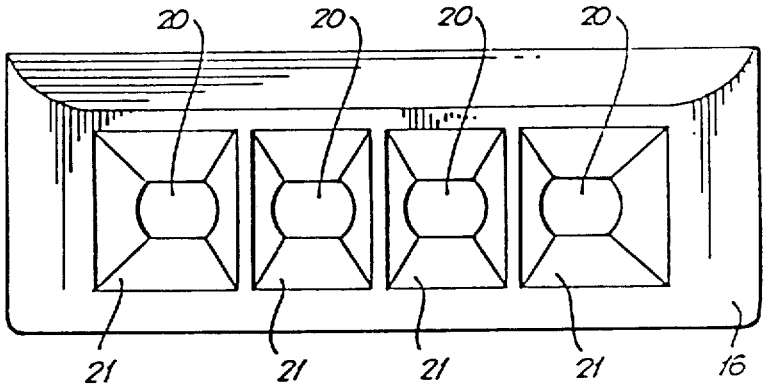
FIG. 16 is a front view of the body of FIG. 15.

At the forward ends of the bores 25 in the ribs 22 chamfers 32 can be formed, seen in FIGS. 3 and 9, and also in FIGS. 6 and 12. These chamfers cooperate with ribs on one form of cap, as will be described.

FIGS. 15 to 19 illustrate a modified form of the body 10 illustrated in FIGS. 3 to 8. To a major extent the body of FIGS. 15 to 19 is the same as that of FIGS. 3 to 8. Certain modifications have been made however to improve dielectric separation between conductors, and between conductors and terminals, and to improve sealing against moisture. Where features are common, common references are used. The body 10 is of box-like form having a relatively thick front wall 16, sides 17 and back 18, all extending up from a bottom web 19. In the front wall are four apertures 20. The forward ends of the apertures are chamfered, at 21, to aid in inserting conductors.

Extending up from the bottom web 19 are ribs 35, 36 and 37. The rear rib 37 is integral with the back wall for the height of the central body, which is very approximately, in the example illustrated, about half the height of the back wall. Ribs 35 and 36 are parallel to the front and back walls, front rib 35 connected to center rib 36 by sections 38, and central rib 36 connected to the rear rib 37 by sections 39. Apertures 25 extend through the ribs 35, 36 and 37, in alignment with apertures 20. A channel 40 extends along the front and each side. Adjacent to the top edge of each side 17, on the inside, is an inwardly projecting rib 29 of truncated cross-section.

In this embodiment, short channels are formed or defined by the ribs 35, 36, 37 and sections 38 and 39. The channels connect or communicate with the apertures 25, for the passage of terminals, in the cap, to make contact with conductors. Thus, as seen in FIG. 15 particularly, four channels 42, 43, 44 and 45 are formed, channels 42, 43 form one pair, in alignment, and positioned to intercept alternate apertures 25 between ribs 35 and 36. Channels 44 and 45 form a second pair, in alignment, and positioned to intercept the other alternate apertures 25, between ribs 36 and 37. Channels 42 and 45 extend into channel 40.

The arrangement of individual channels 42 to 45, instead of continuous channels 26 as in FIG. 3, ensures that if an installer does not push a conductor right in, a cut end of a conductor is not exposed close to a terminal. For example, in FIG. 3, if in the rear channel 26, the terminals contact conductors in the second and fourth apertures 25, counting from the left, then a conductor in either the first or third aperture (or both), if not fully inserted, could have its end exposed in the channel. There could result a low level of dielectric separation, below an acceptable level. This is avoided in the form as in FIGS. 15 to 19.

A further feature is that with the rear rib 37 being integral with the back 18, protection is provided, to the cut ends of the conductors, from any moisture getting down between the back of the cap and the back of the body.

Figure 18:
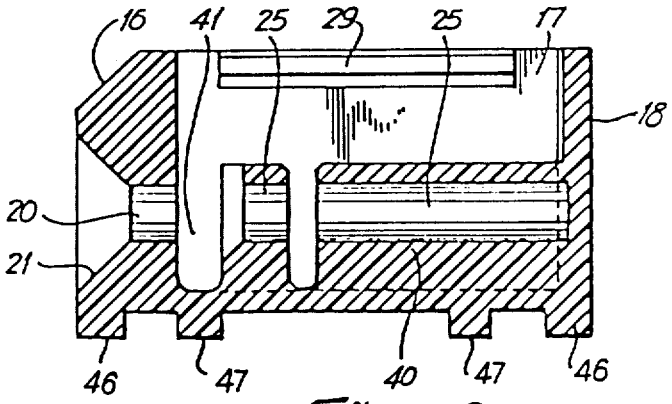
FIG. 18 is a cross-section on the line XVIII—XVIII of FIG. 15.
Figure 19:
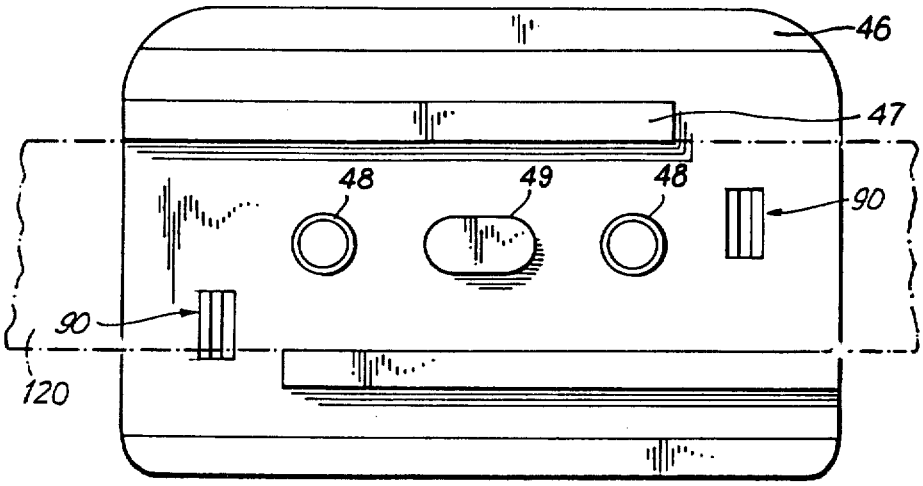
FIG. 19 is a bottom plan view of the body of FIG. 15.

Also seen in FIGS. 18 and 19 is a modification to the bottom of the body. Ribs or rails 50 and 51 are provided at each edge of the bottom surface 52 of the body 10. In the example an outer rib 50 extends along the front and back edges and a second rib 51 extends parallel to each rib 50. Ribs 51 define a channel into which a tape can be positioned. Along the center line there are two sets of protrusions, a pair of circular protrusions 52 and an elongate protrusion 53. The tape has apertures through which the protrusions 52 and 53 pass. Protrusions 52 act as rivets in that the outer ends are deformed and enlarged over the tape to hold the body over the tape. The center protrusion acts as a pressure member for the pliers or other mechanism for squeezing cap and body into a complete installation.

The connector bodies are attached to the tape, and conveniently automatic insertion of terminals and positioning of the cap can be carried out. The cap will be in the first stage of assembly to the body. The connectors on a tape can be fed through a tool which makes the final crimp or assembly after insertion of the conductors, followed by removal of the connector from the tape. An alternative is to attach the bodies to a tape by an adhesive, for example, but the protrusions and apertures ensure a specific spacing, important if automated preassembly is desired.

FIGS. 20 to 25 illustrate in more detail one form of cap 11, which is common to the bodies, 10 and 15. The cap is also of hollow, box-like, form, having front wall 50, side walls 51 and back wall 52, all depending from a top web 53. In the example illustrated, the front wall has four slots 54 extending from a bottom edge up towards the top web 53. These slots 54 define three ribs 55 and at the top of each slot, extending laterally from the ribs 55 and the exposed edges 56 of the front wall 50, are small protrusions 57.

On each side wall 51 there are two sets of protrusions. Near the lower edge 60 there is a single protrusion in the form of a tapered rib 61. Closer to the top web are two spaced protrusions 62, in the form of elongate ribs.

Figure 25:
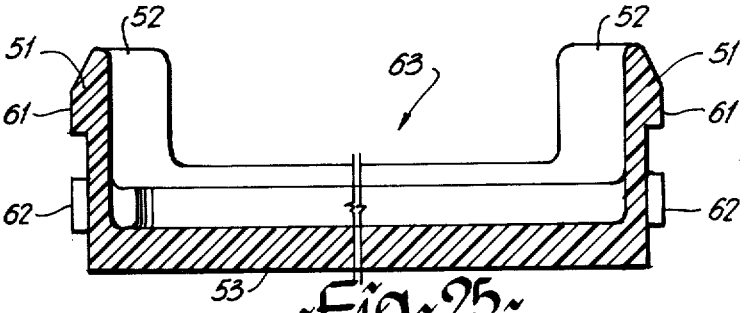
FIGS. 24 and 25 are cross-sections on the lines XXIV—XXIV and XXV—XXV respectively in FIG. 20.

The back wall 52 has a large recess or groove 63 extending from a bottom edge up towards the top web, as seen in FIG. 25 most clearly. The width of the recess or groove 63 is slightly greater than the dimension between the opposed edges 55 in the front wall 50 and the depth of the groove 63 is about the same as the depths of the slots 54.

Figure 22:
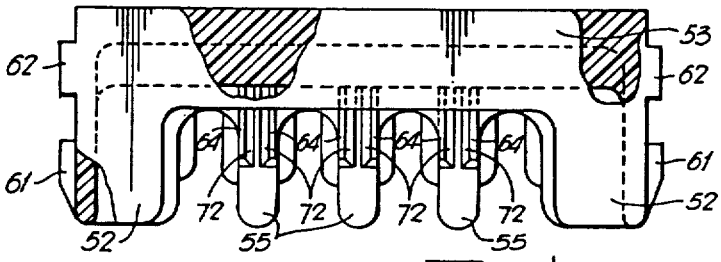
FIGS. 21, 22 and 23 are side views and end view in the directions of arrows A, B and C respectively, in FIG. 20.
Figure 20:
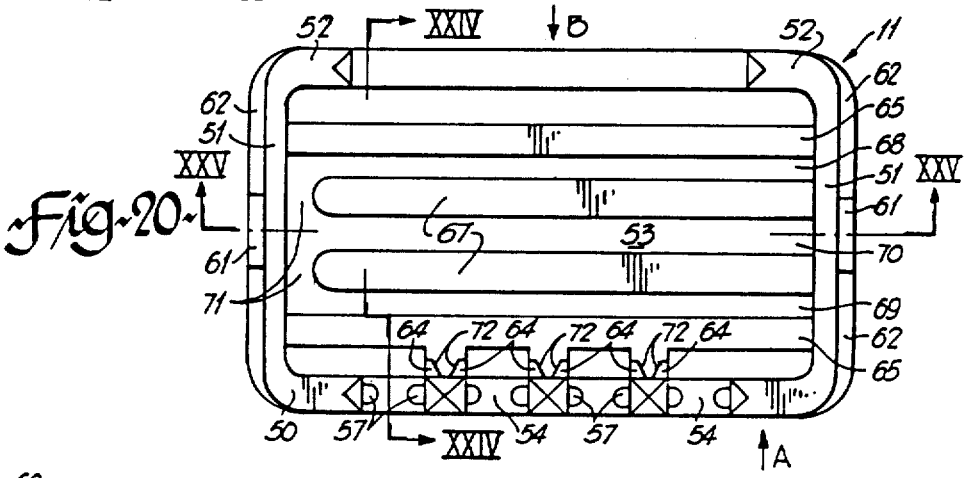
FIG. 20 is a plan view of one form of cap as in the connectors of FIGS. 1 and 2.
Figure 21:
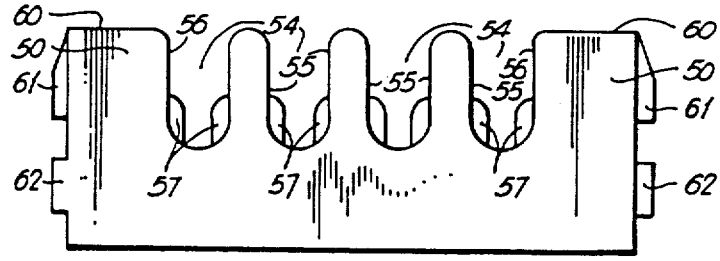
Figure 26:
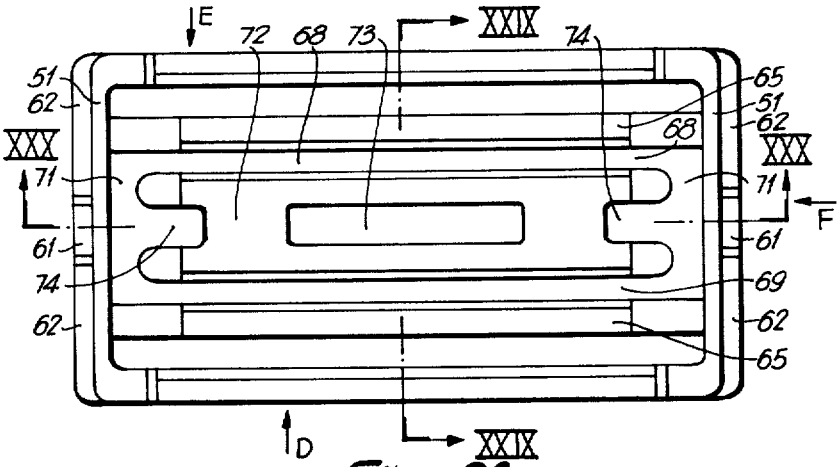
FIG. 26 is a plan view of a further form of cap.
Figure 24:
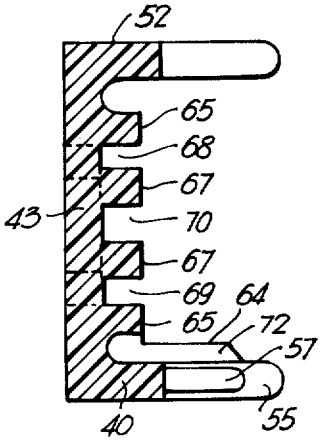
Figure 23:
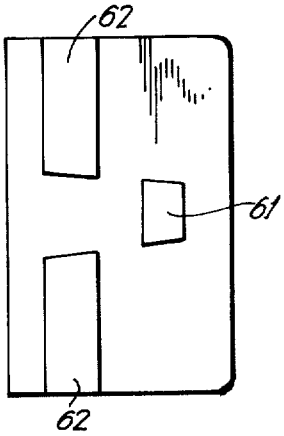
Figure 27:
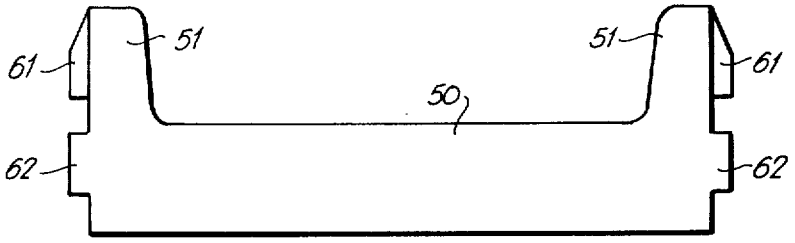
FIG. 27 is a view on the front of the cap of FIG. 26, in the direction of arrow D in FIG. 26 and is also a view on the back as in the direction of arrow E in FIG. 26.
Figure 30:
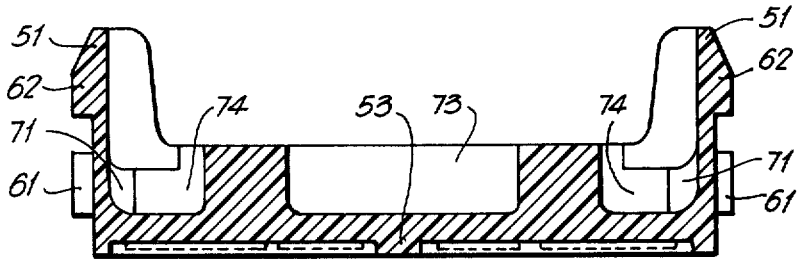
FIG. 30 is a cross-section on the line XXX—XXX of FIG. 26.
Figure 28:
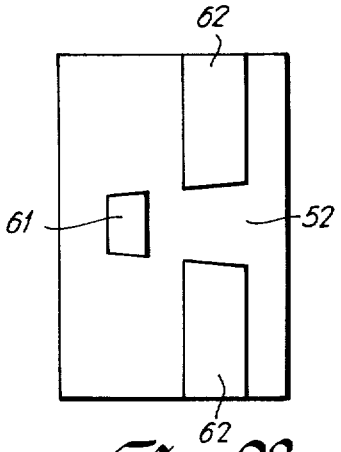
FIG. 28 is an end view in the direction of arrow F in FIG. 26.
Figure 29:
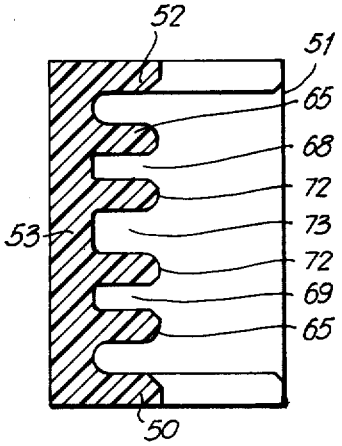
FIG. 29 is a cross-section on the line XXIX—XXIX of FIG. 26.

On the inside of the ribs 55 are short ribs 64, as seen in FIGS. 20, 22 and 24. These ribs are spaced and shaped so as to cooperate with the chamfers 31 on the rib 22 in the body 10 as in FIGS. 3 to 8. Thus the opposed surface 72 slide down in contact with the chamfers 31 on assembly of cap to body. Extending laterally on the inner surface of the top web 53 are two ribs 65, spaced a short distance from the front and back walls. A further two ribs 67 are positioned between ribs 65 and three channels 68, 69 and 70 are thereby defined. The channels 68, 69 and 70 are interconnected at one end by a groove 71.

FIGS. 26 to 30 illustrate an alternative form of cap 11, which can also be common to the bodies 10 and 15. The cap of Figures to 26 30 is very similar to that of FIGS. 20 to 25, and similar references are used where applicable. The cap is of hollow, box-like form, with front wall 50, side walls 51 and back wall 52, all depending from a top web 53. However, while in the form of cap illustrated in FIGS. 20 to 25, there are slots 54 defining ribs 55, in the front wall, in the example of FIGS. 26 to 30, the front wall 50 is of reduced height, effectively forming one aperture extending the width of the cap, instead of a plurality of apertures, as represented by the slots 54 in the cap of FIGS. 20 to 25. The back wall 52 is of reduced height, in the same manner as the front wall 50.

As in the cap of FIGS. 20 to 25, on each side wall 51 there are two sets of protrusions. Near the lower edge 60 there is a single protrusion in the form of a tapered rib 61. Closer to the top web are two spaced protrusions 62, in the form of elongate ribs.

Extending laterally on the inner surface of the top web 53 are two ribs 65 spaced a short distance in from the back and front walls. A further rib 72 is positioned between the ribs 65, to define two channels 68 and 69.

The channels 68 and 69 are interconnected at each end by grooves 71. The center rib 72 has a slot or channel 73 at its center, and short slots 74 at each end.

Figure 32:
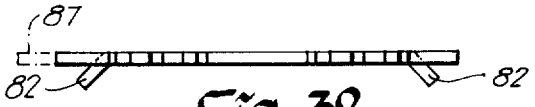
FIGS. 31 and 32 are side view and top plan view respectively of a terminal form as used with the connector of FIG. 1.
Figure 31:
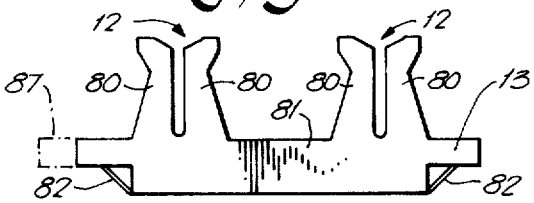

Before considering the assembly of a body and cap, it is convenient to consider the terminals for use in the connector. FIGS. 31 and 32 illustrate one form of insulation displacing terminal 12 suitable for use with a connector as illustrated in FIG. 1. Two terminals 12 form a pair, referenced as 13, corresponding to one of the pairs in FIG. 1. The terminals each comprise two opposed cantilevered beams or legs 80 extending from a base 81. Each leg has its outer surface extending first upward and inward from the base and then upward and outward, forming a neck at the conjuction. These terminals are more fully described in application Ser. No. 166,619 filed July 7, 1980.

At the lower edge of each end of the base a triangular portion 82 is bent out of the plane of the base, to form a sprag. For a connector as in FIG. 1, a pair of terminals is inserted into each channel 68, 69 in the cap 11. One pair is inserted with an end face of the base against one side wall and the other pair is inserted with the end face at the other end in contact with the other side wall. This is indicated in dotted outline in FIG. 1. The caps, and the bodies, are molded of a plastic material, and on insertion of the terminal pairs in a cap, the sprags 82 dig into the plastic and retain the terminals in the channels 68, 69.

Figure 34:
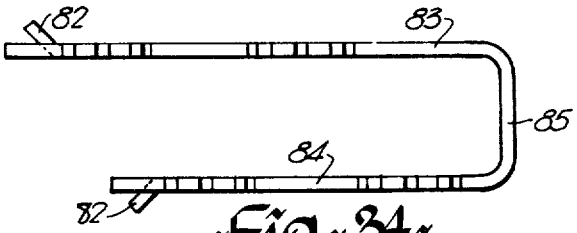
FIGS. 33, 34 and 35 are side view, top plan view and end view respectively of a terminal form as used with the connector of FIG. 2.
Figure 33:
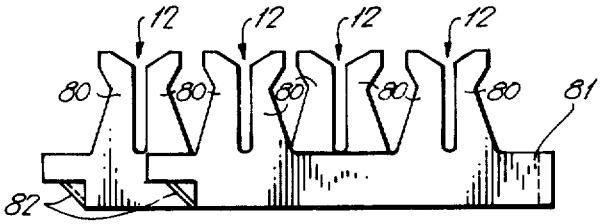
Figure 35:
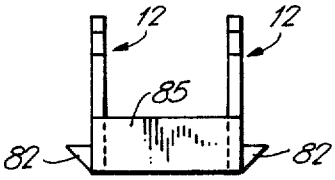

FIGS. 33, 34 and 35 illustrate an alternate form of terminal arrangement for the connector of FIG. 2. Four terminals 12 are in one strip, the terminals basically of the same form as in FIGS. 21 and 22. The strip is bent into a U-shape with two parallel spaced apart legs 83 and 84. The strip is bent such that the terminals 12 in one leg are offset laterally relative to the terminals 12 in the other leg, as seen in FIGS. 33 and 34. The lower corners at each end again have triangular portions bent out to form sprags 82. The legs 83 and 84 are joined by the intermediate portion of the base, identified at 85. For a connector as in FIG. 2, a terminal arrangement as in FIGS. 33, 34 and 35 is inserted into a cap 11. The legs 83 and 84 go into the channels 68 and 69 and the portion 85 goes into a groove 71. The terminals are retained in position by the sprags 82.

Assuming that terminals have been pre-assembled to a cap, the terminals either of the form as illustrated in FIGS. 31 and 32 or 33, 34 and 35, or of some other form, the cap is assembled to the body in two stages. For supplying to users, the body and cap, with inserted terminals, are pushed together so that the cap enters the body, open end first. The tapered ribs 51 are pushed past the ribs 29 in the body, the ribs 29 residing between the tapered ribs 51 and the elongate ribs 52. This holds the cap and body together but in an "open" or "non-connecting" condition.

In this condition conductors can be inserted through the apertures 20. Considering a connector as in FIG. 1 first, for a typical connection, four insulated conductors are inserted, a Tip and Ring of a first pair and a Tip and Ring of a second pair. The Tip and Ring conductors alternate, that is the Tip conductors have a Ring conductor between. The unstripped, i.e. insulated, conductors pass separately and individually through the apertures 20 and the apertures 25 until the ends of the conductors touch the back 18 of the body. The conductors traverse the channels 26 and 27, or slots 42–45, depending on the body form. The contact between conductor ends and the back 18 gives a definitive positioning of the conductors in the connector.

The cap is then pushed fully into the body as by a tool such as a parallel movement pliers. As the cap is pushed in the terminals 12 displace the insulation of the conductors and make contact with the metal conductor core, the terminals being guided in the channels 26 or slots 42–45. For a normal butt connection the terminals in one channel 26, or slots 42 and 43, connect one pair of conductors, for example the two Ring conductors, and the terminals in the other channel 26, or slots 44 and 45 connect the other pair of conductors, i.e. the Tip conductors. If desired, only two conductors can be connected, by inserting the conductors in two of the apertures 20 spaced by one aperture 20. When fully inserted, the elongate ribs 52 extend below the ribs 29 on the body. Generally it is arranged that the cap is flush with the body when fully and correctly installed or crimped thus giving an indication of correct installation. The separators 28, in the example of FIGS. 3 to 8, prevent dielectric breakdown between the ends of adjacent conductors. Additional protection against dielectric breakdown, between two terminal pairs, can be obtained by forming a rib or protrusion on the top surface of rib 23 in the body, indicated in dotted outline at 38 in FIGS. 3 and 6. This protrusion fits into the channel 70, FIGS. 20 and 24.

For a connector of the type as in FIG. 2, it depends on whether a bridge or tap connection is required. For a bridge three conductors are inserted in three of the apertures 20, passing through the apertures 25. The cap is then fully inserted and the terminals displace the insulation and make contact. As the terminal arrangement is as in FIGS. 33, 34 and 35, all three conductors are interconnected. These will be all Ring or all Tip conductors, for a telephone use. Generally two connectors would be used, one for Tip conductors and one for Ring conductors.

For a tap connection, the continuous conductor is inserted into the body through the slot 30 in the side of the body. The conductor snaps through the slot 30 into the aperture 25 and the body is thus retained on the conductor. With the cap in the initial assembly condition this slot is still open. The continuous conductor finishes up extending through the end apertures 20 and 25 at the related side. One or more conductors are then inserted through apertures 20 and 25 and the cap pushed fully in. The terminals displace the insulation and make contact. Again, as the terminal arrangement is as in FIGS. 33, 34 and 35, all the conductors are interconnected. For telephone use one connector would be used for Tip conductors and another connector for Ring conductors. As the cap is pushed fully in, with the elongate ribs 52 engaging under the ribs 29, the side wall 41 of the cap at the side of the groove or slot 30 closes off this slot.

Normally a predetermined amount of a sealing compound is injected into the body prior to the pre-assembly of the body and cap. This compound completely fills the cavity inside the connector and extends into the apertures 20 around the conductors, when the connectors are finally installed or crimped. A pumping action which occurs when the cap and body are fully installed or crimped, forces the compound into the various gaps and clearances around the conductors, including into the various orifices in the body and gaps between the body and cooperating surfaces of the cap.

Figure 17:
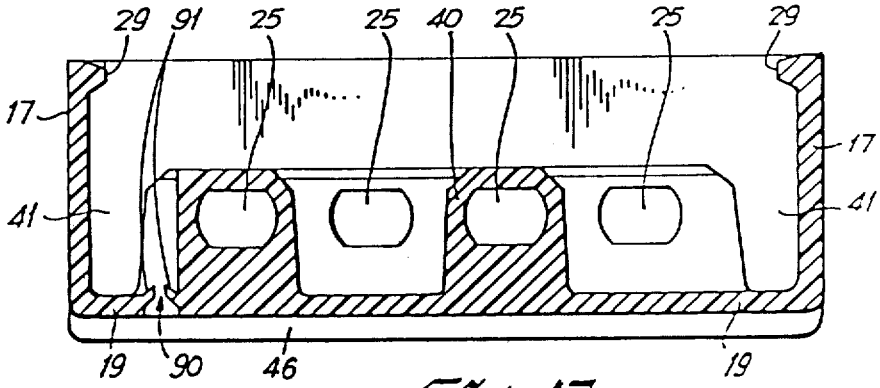
FIG. 17 is a cross-section on the line XVII—XVII of FIG. 15.

It is advantageous to provide test ports, either in the body or the cap. Test ports in the body are seen in detail in FIGS. 15 and 17. The test ports, indicated at 90, are provided in the bottom web of the body. The test ports are aligned with the terminals in the cap and enable electrical test connections, via probes. In the example illustrated in FIGS. 15 and 17, the terminals would be extended, as shown in dotted outline at 87 in FIGS. 31 and 32, to enable contact to be made. In the example illustrated in FIGS. 15 and 17, the ports are rectangular, and as seen in FIG. 17, have inwardly directed flaps 91. The flaps 91 serve two purposes. Firstly they prevent, or at least considerably reduce, the issue of grease through the ports when the connector is finally crimped or assembled. Also, when a probe is pushed in, the flaps deflect slightly and wipe grease off the probe when the probe is withdrawn, retaining it in the connector. One particular form of probe end 92 for use with ports 90 is illustrated in FIGS. 36 (*a*) and (*b*). The probe end is generally oblong in cross-section, slightly narrower than the length of the port and slightly thinner than the width of the port but slightly thicker than the width of the gap between the flaps 91. Other forms of ports, and probes, can be used. Ports can also be provided in the cap as indicated in dotted outline at 93 in FIG. 1. Ports 90 are also indicated in the body 15 in FIG. 9.

While the provision of test ports is not essential, it is preferred. The ability to test by inserting probes through a port is a considerable advantage as compared with a contempary system in which sharply pointed probes are used to pierce the insulation of the conductors external to the connector. This leaves a permanent perforation in the insulation, with possible ingress of moisture. The test ports can also be used with connectors not filled with grease. In some instances, only a test port is required.

The present connector has many advantages over existing connectors. In effect a family of connectors is provided which are suitable, or adaptable, to various types of connection, or interconnection, with various forms of conductors. For convenience, it is desirable to keep the number of different parts to a minimum, both for cost and for minimum stock. As described previously there are various forms of body and cap, which can be provided both with and without test ports.

One advantage is that the conductors, in making connections for telephone systems, are inserted as pairs, for a butt connection. Thus, a first pair of conductors, comprising a Tip conductor and Ring conductor, is inserted in adjacent apertures 20. Then the second pair of conductors is inserted. In many forms of known connectors, it is necessary for the installer or repairer to separate pairs of conductors, match the two Tip conductors together and insert them into a connector, make the connection, then match up the two Ring conductors, insert into a connector and make the connection. As often a very large number of connections are being made at one time even slight reductions in time and improvements in ease of insertion and assembly represent substantial overall gains and improvements, in time and costs. Also, convenience of application of connectors also assists in obtaining improved quality of connection.

As described above, depending upon the type of connection to be made, not all of the apertures 20, 25, will be used. Thus, in the cap 11, not all of the slots 54 will be used. In the example of a connector with a body as in FIGS. 3 to 8 or 9 to 14, with a cap as in FIGS. 20 to 25, lateral, or sideways, distortion of a rib 55, from a slot occupied by a conductor towards a slot unoccupied by a conductor, is prevented as the ribs 54 are in engagement with the chamfers 31. Thus the alignment of the ribs 55, whih provide strain relief, is maintained. This effect is also obtained if two conductors of different diameters occupy adjacent apertures 20, 25. Thus the connector will accept and efficiently connect two, three, or four conductor, and also accept and connect conductors of differing sizes, an advantage over other connectors. However, in extremely low temperatures, the flow of grease into the apertures 20 and 25, around the conductors can be restricted by the ribs 64, and a cap of the form of FIGS. 26 to 30, can be used. The cap of the form of FIGS. 26 to 30 can also be used at other than low temperatures.

The connector has, in effect, a two stage assembly or installation. There is an initial stage in which the particular terminal arrangement is in position in the cap and the cap is assembled to the body to a first position, the tapered ribs 51 beyond the ribs 29. The sealing compound, if used, is injected, with the body, usually before such initial stage. The connectors can be packaged for storage. The second stage occurs when conductors have been inserted and the body and cap then pushed or crimped completely together. The two stages of assembly or installation are seen in FIGS. 38(*a*) and 38(*b*). In FIG. 38(*a*), the terminals 12 are positioned clear of the apertures 25, with the ribs 29 between protrusions 61 and 62. This enables conductors 125 to be pushed into the apertures 25. FIG. 38(*b*) shows the cap pushed right into the body, with the terminals pushed down and in contact with the conductive cores 126 of the conductors 125. The ribs 29 are now above the protrusions 62. It will be seen that the base 81 of a terminal pair is separated from an intervening conductor by dielectric material of the body.

The connector is small and compact. In many instances only one connector is required instead of two. Particularly in telecommunications, where large number of connectors are used to connect conductors of cables, improved ease of connection, reduction in connection time, reduction in the number of connectors and minimal size are all very important factors.

Conveniently, the body can be molded of a translucent or opaque material and the cap of a coloured material. A proper, fully inserted assembly or "crimp" can be ascertained as when surfaces of the coloured part move into contact with the translucent part, the coloured part becomes very visible on a proper crimp. The presence of a sealing compound enhances this effect.

FIG. 37 (*a*), (*b*) and (*c*) illustrate very diagrammatically the various types of connections which can be made, and particularly exemplified by telephone conductors. In FIG. 37 (*a*), two butt connections are made, between two Tip conductors 95 and 96 and between two Ring conductors 97 and 98. In FIG. 37 (*b*), a bridge connection is made between three conductors 99, 100 and 101. For telephones, if these are Tip conductors, then another bridge connection is made for Ring conductors 102, 103 and 104. In FIG. 37 (*c*), a tap is made to a continuous Tip conductor 105, with one or two conductors 106 and 107 and a further tap to a continuous Ring conductor 108 by one of two conductors 109 and 110. The conductors are not necessarily shown in the actual positions as assumed in the connector, but are illustrative only.

While the connector has been described with the cap being inserted into the body, it will be appreciated that only minor modifications need be made to reverse this and have the body inserted into the cap. The main changes are in the ribs 29, 51 and 52, ribs 51 and 52 being put on the outside of the body and ribs 29 on the inside of the cap. Also, the form and arrangement of the ribs 29, 51 and 52, can be varied, the object being the two stage assembly. It will also be appreciated that the basic geometry or structure of the body and cap can be modified to accept more than four wires. Also more than two pairs of terminals can be provided but the connector then becomes larger and more complex.

What is claimed is:

1. A connector for connecting at least two conductors, comprising a body and a cap each of hollow box-like structure, the cap fitting into or over the body;

the body comprising;

a bottom web;

front and back walls and opposite end walls extending up from said bottom web;

a central body portion having front, central and rear ribs, the rear rib integral with the back wall;

four apertures extending through said front wall and said front, central and rear ribs, the apertures extending in spaced parallel array to form first, second, third and fourth apertures;

the front and central ribs connected by first spaced sections to define a first two aligned spaced apart channels one channel connecting with the first aperture and the other channel connecting with the third aperture;

the central and rear ribs connected by second spaced sections, to define a second two aligned spaced apart channels, one channel connecting with the second aperture and the other channel connecting with the fourth aperture;

the cap comprising;

a top web;

front and back walls and opposite side walls, extending down from said top web;

the front wall being of reduced height for at least a major part of its length, relative to said side walls, to define an open sided aperture in the front wall;

front and rear ribs extending down from said top web, spaced from and parallel to the front and back walls, and a central rib extending down from said top web intermediate the front and rear ribs, parallel to and spaced from the front and rear ribs, to define four parallel channels, the channels between said central rib and said front and rear ribs adapted to receive insulation displacing terminals;

a further channel extending along inside each side wall;

interengaging formations on the side walls of the cap and the end walls of the body, said formations interengaging to retain said cap and said body in a first initial assembled position with said terminals entered in the channels but clear of said apertures in said body, and also adopted to interengage to retain said cap and said body in a second, fully inserted position with said terminals extending across said apertures in said body and in electrical connection with the conductive cores of conductors positioned in said apertures in said body.

2. A connector as claimed in claim 1, including a pair of terminals in each of said channels between said central rib and said front and rear ribs, the terminals of one pair offset relative to the other pair, and a conductive portion positioned in one of said further channels extending along inside each side wall, the conductive portion joining the pairs of terminals together.

3. A connector as claimed in claim 1, including a predetermined quantity of sealing compound in the connector.

4. A connector as claimed in claim 1, including at least one test port extending through the web of at least one of said body and said cap and aligned for contact with a terminal.

5. A connector as claimed in claim 4, each said test port being rectangular in plan form, and including opposed inwardly directed flaps, one on each side of said port, said flaps extending towards each other to at least partly close said port.

6. A connector as claimed in claim 5, including two test ports in said bottom web of said body.

7. A connector as claimed in claim 5, including two test ports in said top web of said cap.

8. A connector as claimed in claim 7, including a channel extending along each side and along said front wall, between said front wall and said front rib.

9. A connector as claimed in claim 1, said cap fitting in said body.

10. A connector as claimed in claim 9, said interengaging formations comprising:

an inwardly projecting rib adjacent to and parallel to an upper edge of each side of the body;

at least one first outwardly projecting protrusion adjacent to a lower edge of each side wall of the cap; and at least one further outwardly projecting protrusion spaced from said lower edge of each side wall of the cap, said first protrusion engaging over said inwardly projecting ribs at a first stage of assembly and said further protrusions engaging over said inwardly projecting ribs at a second stage of assembly.

11. A connector as claimed in claim 9, including a slot in one of said sides of said body, said slot extending to and breaking into the aperture and guide means adjacent to said side.

12. A connector as claimed in claim 11, said slot in one of said sides being of tapered cross section in a transverse plane normal to said sides and said bottom web, whereby a conductor snaps through said slot into the aperture and guide means.

13. A connector as claimed in claim 11, the side walls of said cap extending beyond the slot in the said side of said body when in a fully assembled condition.

14. A connector as claimed in claim 1, including a pair of ribs extending longitudinally on the bottom surface of the body, parallel to said front and back, said ribs defining a channel.

15. A connector as claimed in claim 14, said ribs spaced inward from said front and back, and a further pair of ribs on said bottom surface extending along edges of said bottom surface adjacent to said back and front.

16. A connector as claimed in claim 14, including at least two protrusions extending from said bottom surface, through said tape.

17. A connector as claimed in claim 16, including a further protrusion extending from said bottom surface between said two protrusions.

* * * * *